US006185751B1

(12) United States Patent
Mason

(10) Patent No.: US 6,185,751 B1
(45) Date of Patent: Feb. 13, 2001

(54) RELEASABLY ENGAGABLE SOCKS

(76) Inventor: Susan D. Mason, 2510 W. 54th South, Mountain Home, ID (US) 83647

( * ) Notice: Under 35 U.S.C. 154(b), the term of this patent shall be extended for 0 days.

(21) Appl. No.: 09/412,041

(22) Filed: Oct. 4, 1999

(51) Int. Cl.[7] ..... A43B 17/00
(52) U.S. Cl. ..... 2/239; 24/DIG. 29
(58) Field of Search ..... 2/239, 160, 409, 2/61; D2/980; 24/DIG. 29, 444, 442, 446

(56) References Cited

U.S. PATENT DOCUMENTS

| | | | | |
|---|---|---|---|---|
| 1,719,082 | * | 7/1929 | Regar | 2/239 |
| 2,663,877 | * | 12/1953 | Bohman | 2/239 |
| 2,710,409 | * | 6/1955 | Burandt | 2/160 |
| 3,196,640 | * | 7/1965 | Hanisch | 66/172 |
| 3,414,944 | * | 12/1968 | Rabinowitz | 24/81 |
| 3,699,617 | | 10/1972 | Hofmeister . | |
| 4,058,853 | | 11/1977 | Boxer et al. . | |
| 4,414,716 | | 11/1983 | Stastney . | |
| 4,975,986 | * | 12/1990 | Strongwater | 2/160 |
| 5,038,413 | | 8/1991 | Ursino . | |
| 5,321,855 | * | 6/1994 | Ciuffo | 2/239 |
| 5,367,809 | * | 11/1994 | Ross | 40/668 |
| 5,450,658 | * | 9/1995 | Hicks | 24/303 |
| 5,579,541 | | 12/1996 | Christy et al. . | |
| 5,740,558 | | 4/1998 | Messman . | |
| 5,918,318 | * | 7/1999 | Jones | 2/239 |
| 5,970,524 | * | 10/1999 | Becker et al. | 2/239 |
| 5,974,590 | * | 11/1999 | Stubbs | 2/239 |

OTHER PUBLICATIONS

Gershman, Maurice, Journal of the American Medical Asso., vol. 168, No. 7, p. 930, Oct. 1958.*

* cited by examiner

*Primary Examiner*—John J. Calvert
*Assistant Examiner*—Alissa L. Hoey
(74) *Attorney, Agent, or Firm*—Frank J. Dykas; Robert L. Shaver

(57) ABSTRACT

There exists many different devices for connecting articles of clothing together. The present invention is such a device for attaching articles of clothing together. The present invention utilizes paired fasteners on each of the two articles of clothing to be attached together. This allows the two articles to either be attached together or turned inside out and folded upon themselves and attached to themselves. In this folded-down state, the fasteners are hidden from view.

6 Claims, 11 Drawing Sheets

RELEASABLY ENGAGABLE SOCKS

BACKGROUND OF THE INVENTION

1. Field of the Invention

The present invention generally relates to apparel and clothing, and more particularly to articles of apparel fastened together to prevent separation thereof during washing, storage, drying and the like.

2. Background Information

There are many times when articles of clothing need to be attached together. For instance, one might want to attach together a pair of socks after wearing them, then when the wearer tosses the socks into the laundry, the socks are washed and dried together and the socks come out of the dryer already mated. This would be a great savings of time and effort to a person doing laundry.

Other examples of instances when a person might wish articles of clothing to be paired together would include children's clothing. For instance, children frequently loose their gloves and mittens, an annoying problem for many parents. These parents would benefit from using a means for fastening the gloves or mittens to the article of outerwear the child would be wearing so that the gloves or mittens would not become misplaced or lost.

There are many devices for connecting articles of clothing together. The first is U.S. Pat. No. 3,699,617 to Hofmeister, showing a connecting device for articles of clothing. A disadvantage of the Hofmeister device is the bulky connector on the socks as worn. A simple, easy to use, small and discrete device of attachment is needed.

Another device is shown in U.S. Pat. No. 4,058,853, to Boxer et al. The Boxer device shows socks with flexible, self-contained fastener patches. However, the Boxer device would not be aesthetically pleasing in that the fasteners would be observable by others when being worn.

Another device is shown in U.S. Pat. No. 5,038,413 to Ursino. The Ursino device is a sock fastening means, comprising a male snap on one sock and a female snap located on another sock. The Ursino device further has covers which snap on to protect the snaps when worn. A disadvantage of such device is that it is observable when worn.

U.S. Pat. No. 5,579,541 to Christy et al. shows sock tabs. Christy sock tabs comprise Velcro®-style attachments for attaching pairs of socks together when not worn. However, the Christy device would also be easily visible to others when being worn.

Finally, U.S. Pat. No. 5,740,558 to Messman shows a means for attaching articles of clothing together. Messman's device comprises tabs which are sewn into the clothing articles, the tabs having snaps which allow the clothing items to be snapped together. However, the Messman device does not show the attachment means located on the outer side of the leg of each sock.

What is needed is an attachment means for attaching articles of clothing together which has plural fastening means on each article allowing the articles to be either attached together or allowing the individual articles to be folded and fastened upon itself, thereby covering the fasteners. The preferred embodiment of the present invention solves these needs.

Additional objects, advantages and novel features of the invention will be set forth in part in the description as follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

The present invention is a device for attaching at least two articles of clothing together. The device has a plurality of fasteners located on each one of the articles so that the articles can either be attached to one another or an individual article can be folded and attached to itself, thereby covering the fastener upon the article.

In the preferred embodiment of the present invention, the fasteners comprise snap together fasteners having a male part and a female part, whereby the male part is fastened into the female part, thus giving a snap-like connection. This type of fastener is common to apparel. In its preferred embodiment, one male and one female fastener is located on each article of clothing. This allows the article of clothing to be folded so that its own male part may be fastened to its own female part. In doing so, the folded-down portion of the article of clothing would cover the fastener.

Possible fastening means include Velcro®, hooks and loops, and others. The present invention may also be placed on any number of articles of clothing, and the first article and second article of clothing joined together need not be of the same type of article, for instance, a stocking cap fastened to a pair of gloves.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
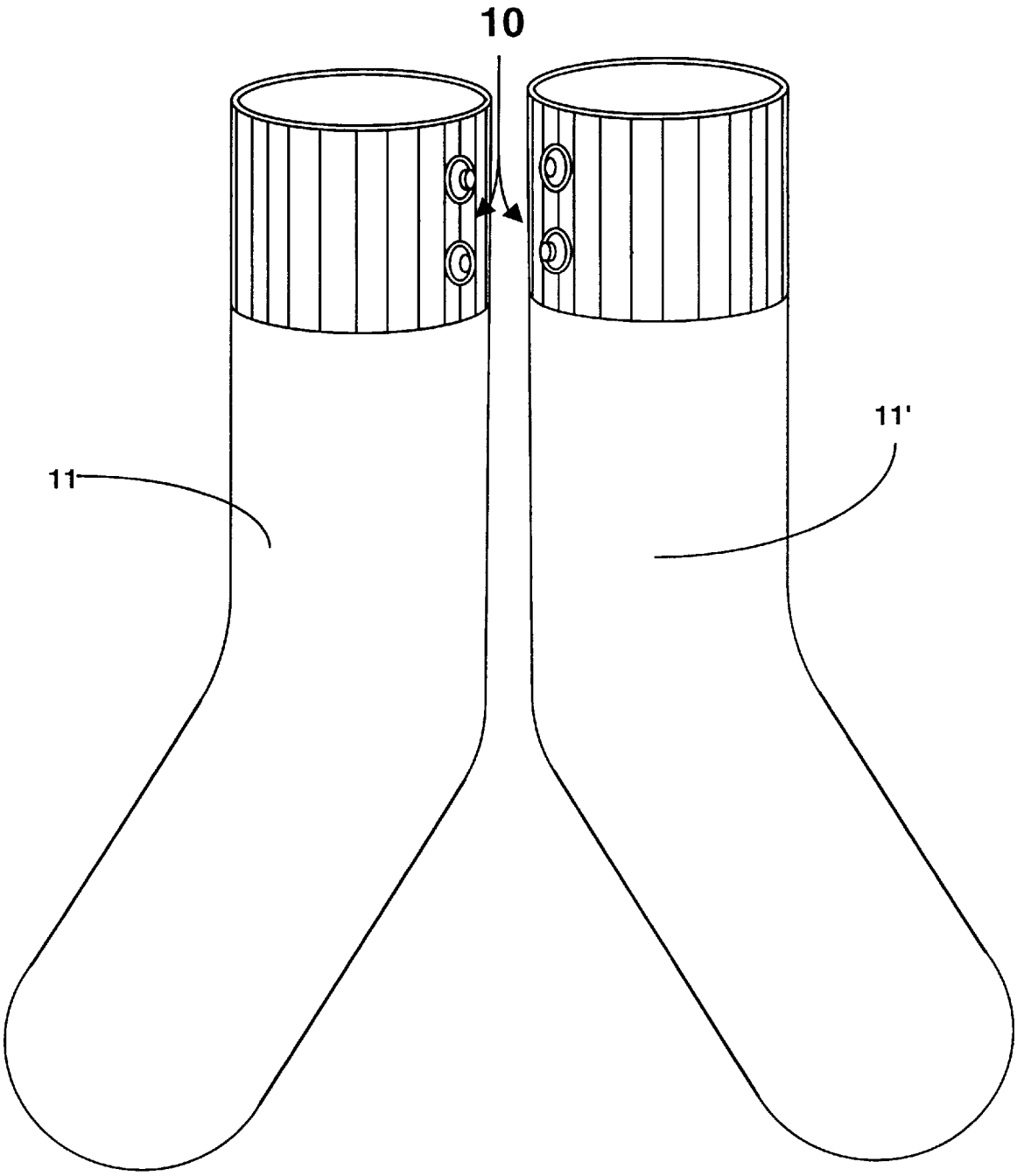
FIG. 1 is a perspective view of an embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a device for attaching articles of clothing together. While there are many different types of articles that could be attached together using the present invention, for instance, gloves or mittens together on or to the sleeves of jackets or other garments, the preferred articles are hosiery, namely socks.

Figure 2A:
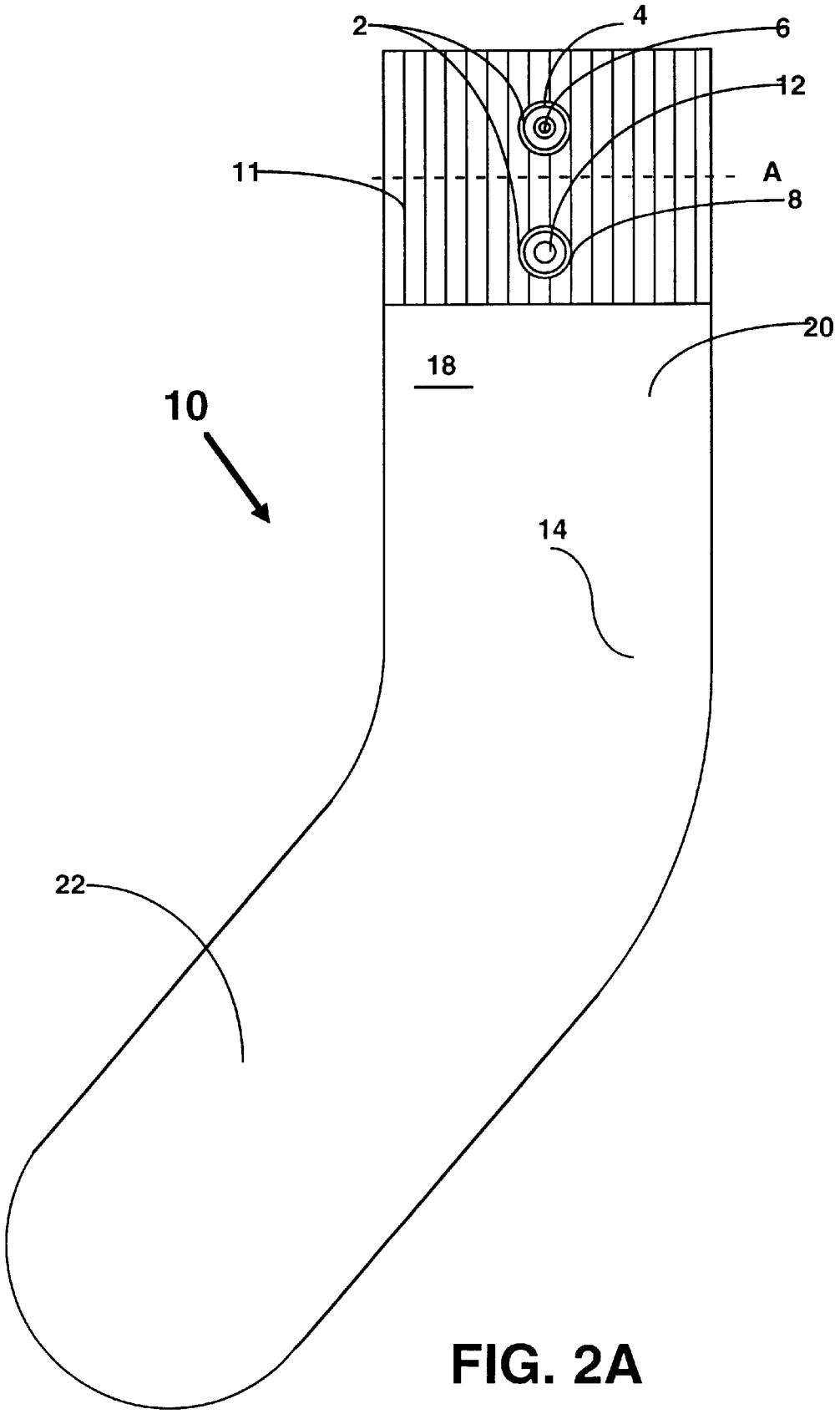
FIG. 2A is a side view of a first article of clothing employing an embodiment of the invention.
Figure 2B:
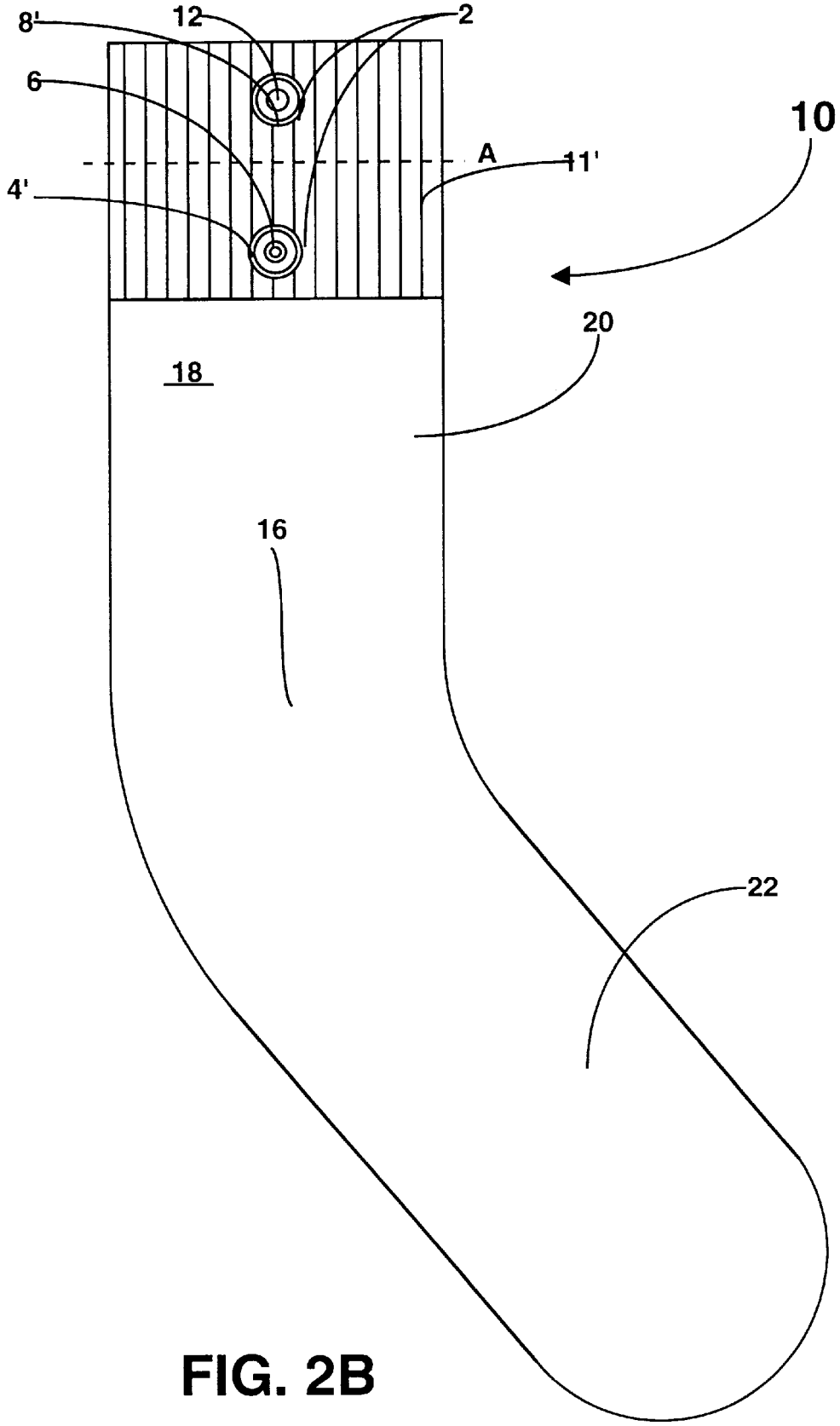
FIG. 2B is a side view of a second article of clothing employing an embodiment of the invention.

In such an arrangement, the device 10 attaches a first article 11 to a second article 11'. As shown in FIG. 1, the preferred embodiment 10 of the present invention comprises a pair of socks further comprising a first sock 11 and second sock 11'. "Socks" are referred to in this application as the preferred articles, however, any articles of clothing or apparel may be used, and the term "socks" is intended to refer to any article of clothing. Each of these socks (11, 11'), have fastening means 2 for securing the pair of socks together to prevent the separation of the socks during sorting, storage, washing, drying or the like, as shown in FIG. 2A and FIG. 2B. An individual sock has a first side 14 opposite a second side 16. The socks also have an outside surface 18 and have a leg portion 20 which contacts a wearer's leg and a foot portion 22, which contacts a wearer's foot.

The type of fasteners can be any fasteners known to man, however, the fastening means 2 are preferably either hook and loop "Velcro®"-type fasteners or, as shown in the Figures, snap-type fasteners.

In the case of the snap-type fasteners 2, a set of such fasteners comprise a first fastener (4, 4') having a part providing a projection 6 which is received into a second fastener (8, 8') having a part providing a hole 12. These first and second fasteners are constructed and arranged so that they are releasably engagable with one another with the projection fitting within the hole with a snap-like fit, and thus are referred to as snap-type fasteners.

Figure 4:
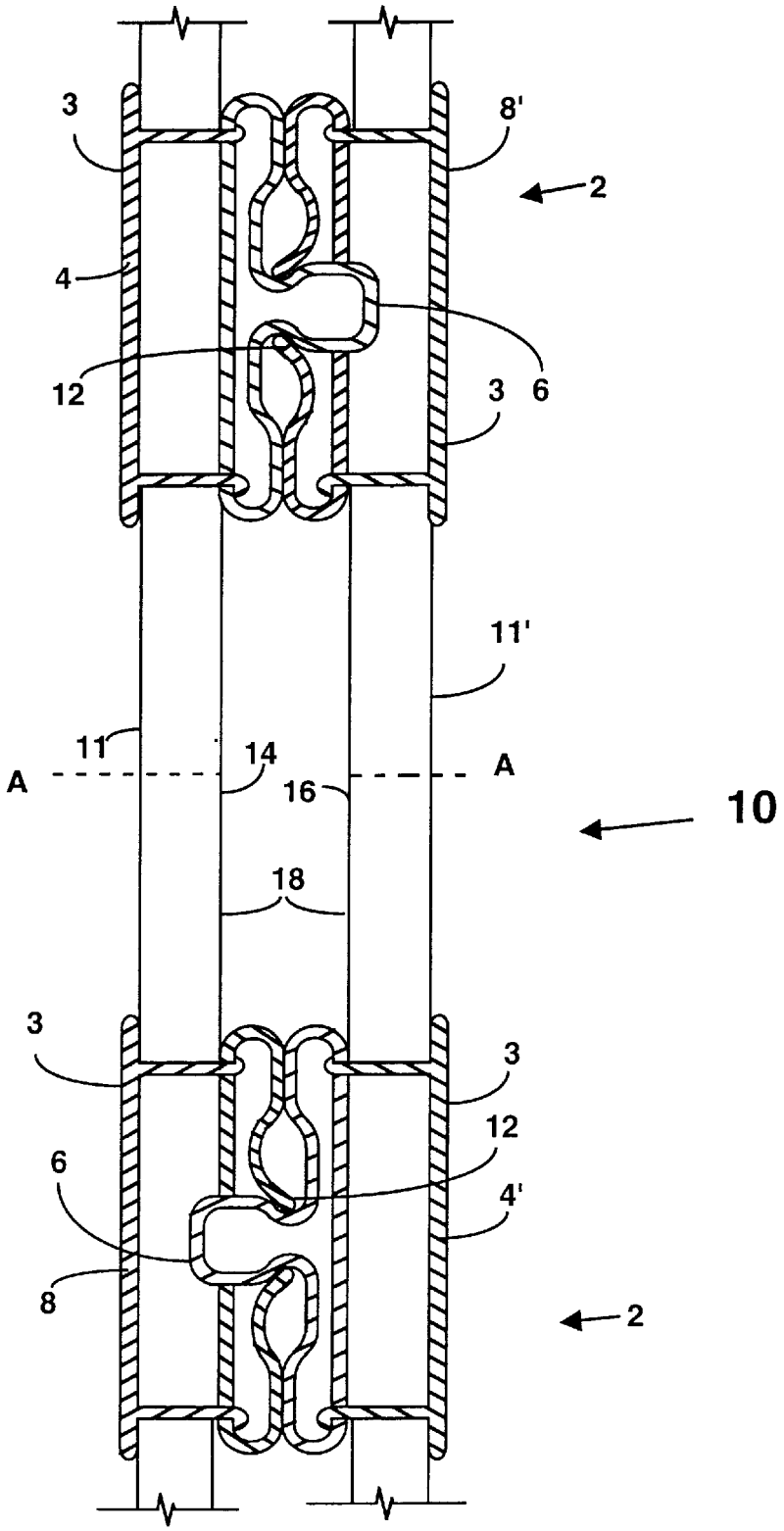
FIG. 4 is a cross-section along line 4—4 of FIG. 3.
Figure 6A:
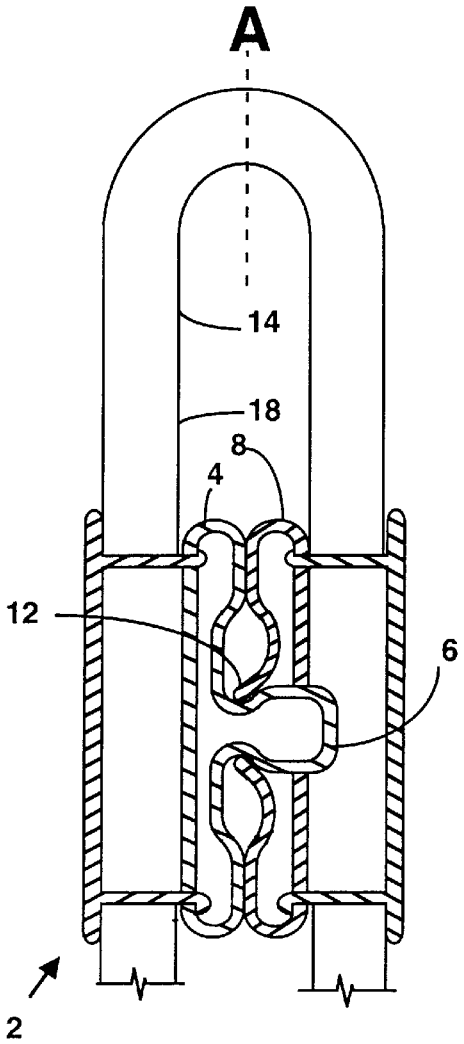
FIG. 6A is a cross-sectional view of FIG. 5 at line 6A—6A.

These fasteners are attached to the articles of clothing through use of an attachment means 3. These attachment means 3 can be anything commonly used by those skilled in the trade of apparel manufacture, including but not limited to, the use of an adhesive to adhere the fastener to the outer side 18 of the leg 20 of each sock, and/or through the use of rivet-style snap-type fastening means which are riveted through the fabric of the article of clothing and fixedly crimped in place, as shown in FIG. 4 and FIGS. 6A/6B. The exact manner of attachment is not important so long as the fastener is securely held in place.

Figure 3:
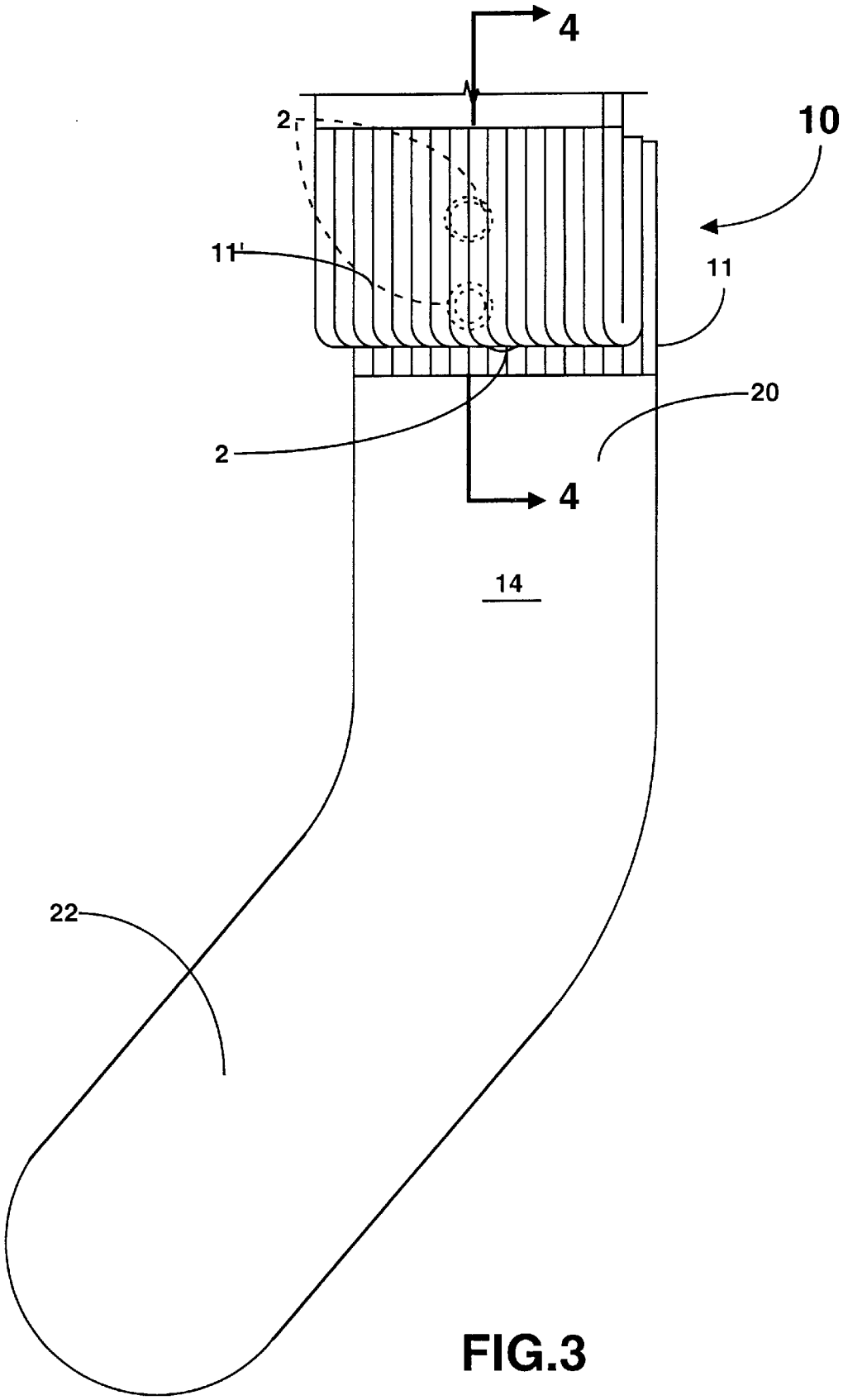
FIG. 3 is a partial, perspective view of the articles of FIGS. 2A and 2B fastened together.

Both the projection and hole providing parts of the first and second fasteners are preferably arranged on the outer surface 18 of the leg portion 20 of each sock so as to face outwardly from the outer side 18. This allows the socks to be attached to one another, as shown in FIG. 3

As shown in the Figures, it is preferred that two fasteners 2 will be affixed to each sock. On the first sock 11, the fasteners would be placed on the first side 14 of the sock 11, and on the second sock 11' the fasteners would be placed on the second side 16 of the sock 11'. It is preferred that a plurality of fasteners would be used on each sock. In the preferred embodiment, one of the first fasteners 4, 4' providing a projection 6 would be located on each sock (11, 11') and each one of the second fasteners 8, 8' providing a hole 12 would be located on each sock (11, 11') as well, as shown in FIG. 1. It is preferred that the plurality of fasteners be oriented in a vertical manner as the socks would be worn and that the fasteners alternate between a first fastener and second fastener, again as shown in FIG. 1.

In the preferred embodiment, on the first sock a first fastener would be located most vertical and directly below the first fastener would be located one of the second fasteners, as shown in the figures. The same would be repeated on the second sock, except the second fastener would be located above the first fastener. Such an arrangement would allow the first faster of the first sock to either engage the second fastener of the second sock or the second fastener of the first sock.

Figure 5:
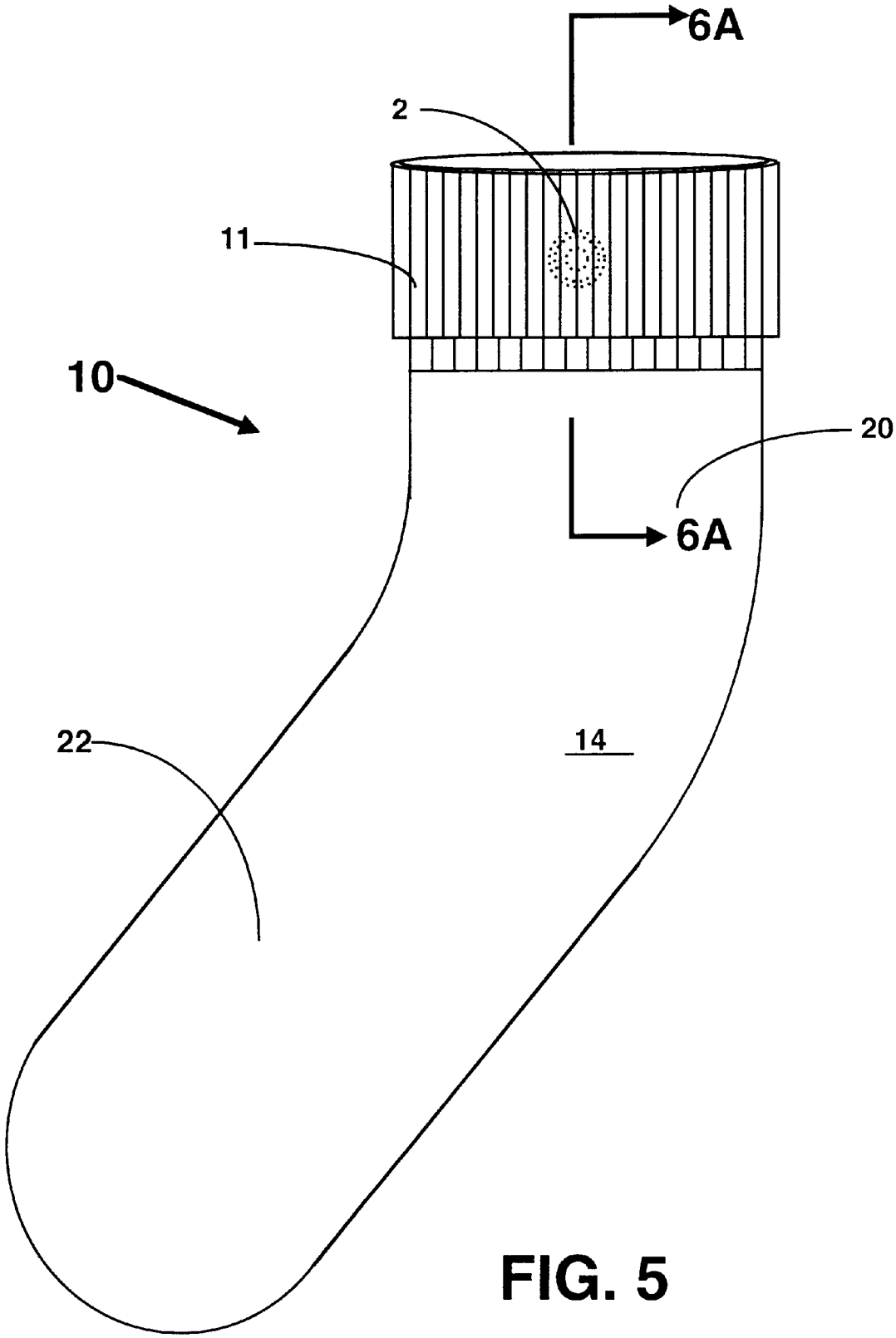
FIG. 5 is a perspective view of an embodiment of a first article shown in FIG. 2A, in its folded-down state.

When engaging the second fastener of the first sock, the first fastener of first sock can only do so through the folding, rolling down, or bending of the article back upon itself so that the two fasteners can engage, as shown in FIG. 5. This has the added benefit of folding over and covering up the exposed surfaces of the fasteners. The sock could subsequently be rolled down another time, thereby folding it over and making the existence of such a fastener even less obvious to an observer.

Being in oriented in such a alternating manner also allows multiple releasable engagements between the fasteners on the first sock and the fasteners on the second sock, as shown in FIGS. 4 and 5. This multiplicity of fasteners adds to the strength of the attachments between the two paired socks, assisting greatly in holding the socks together, particularly in the washing machine and dryer.

Figure 6B:
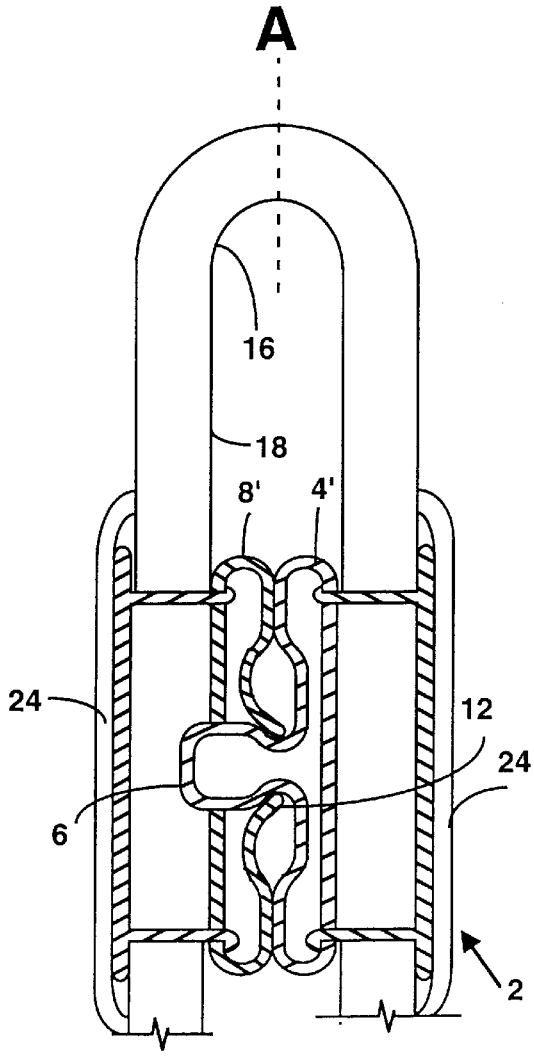
FIG. 6B is a cross-sectional view of one embodiment of a second article in its folded-down state.
Figure 7:
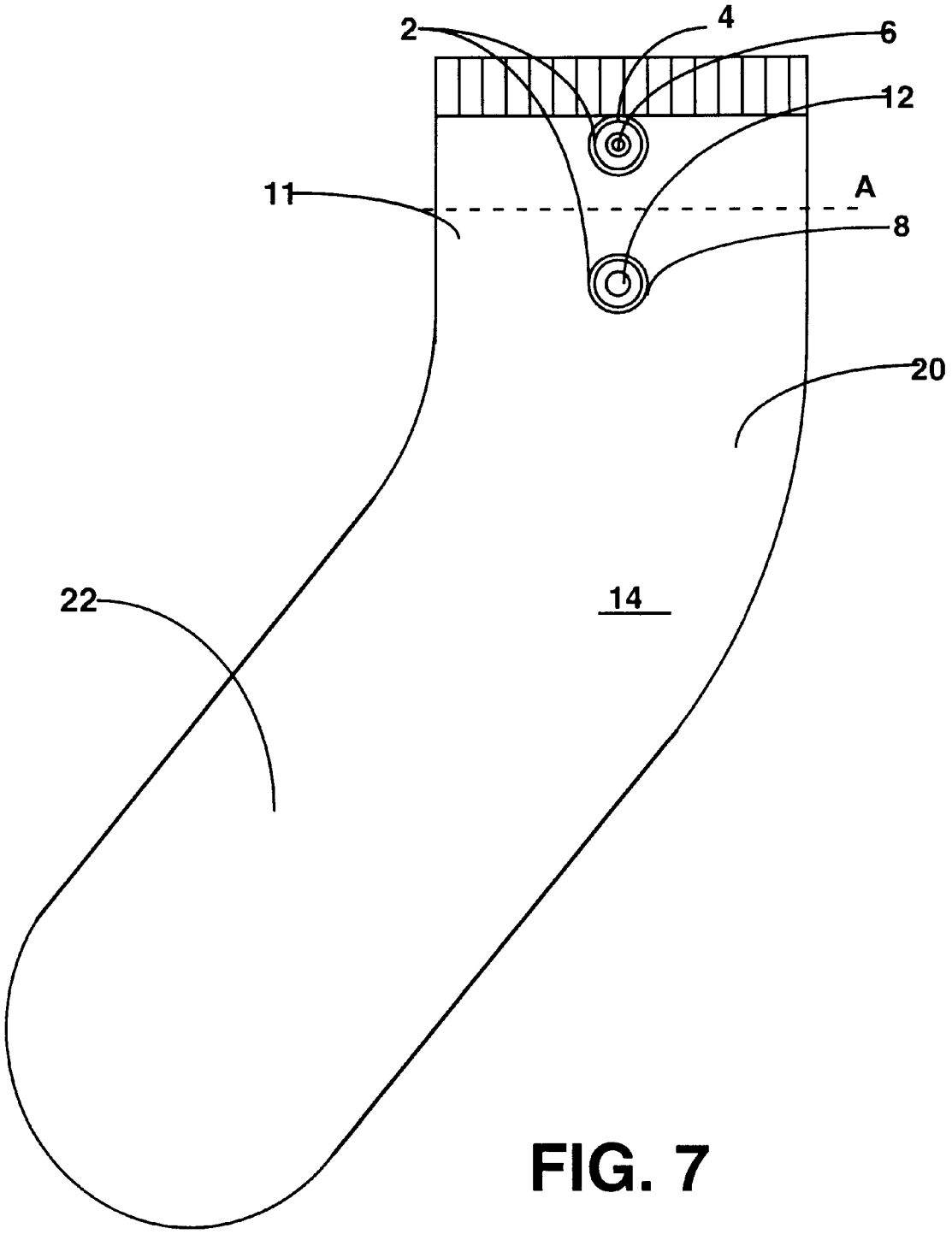
FIG. 7 is a side view of another embodiment of one article of the present invention.
Figure 8:
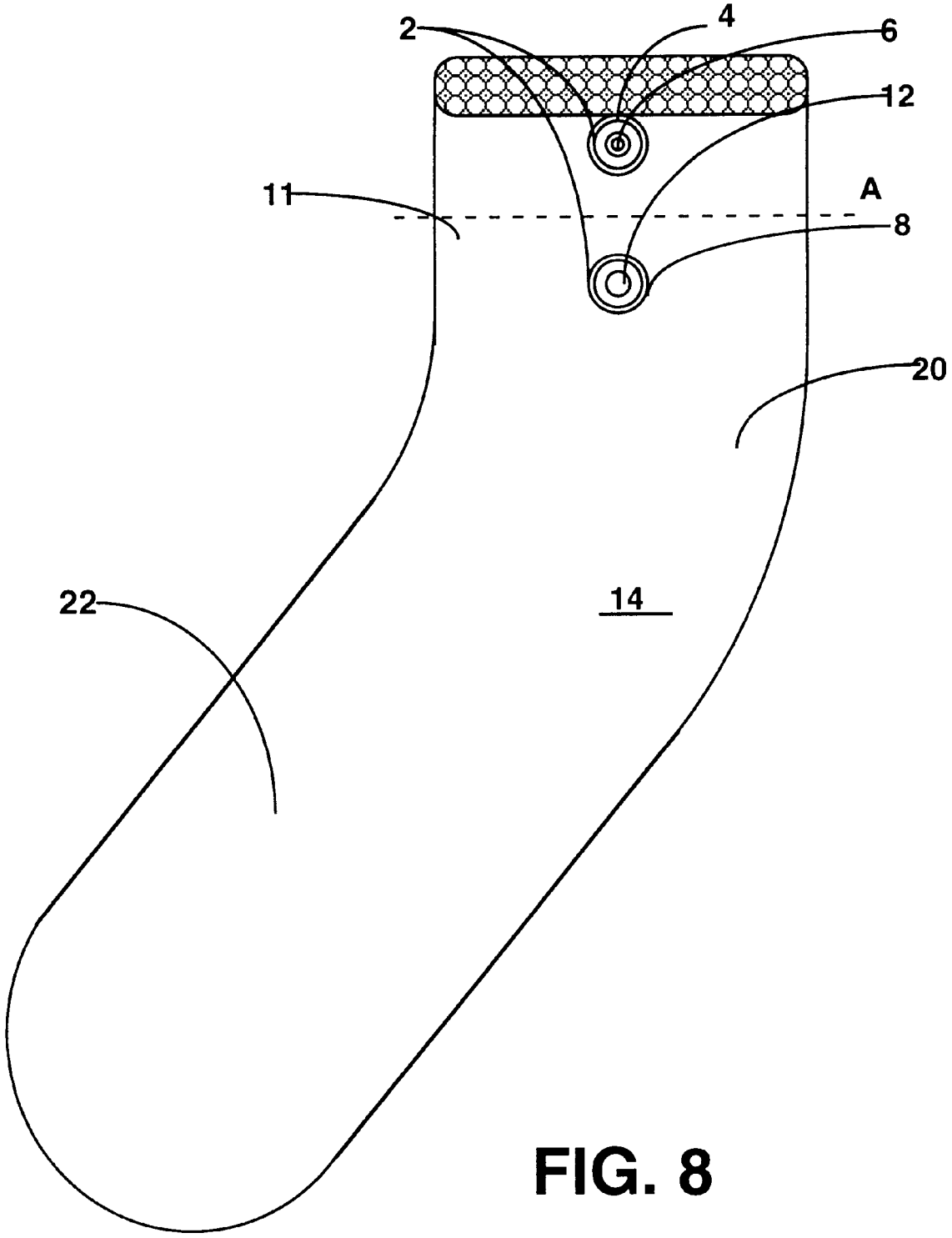
FIG. 8 is a side view of another embodiment of one article of the present invention.

As shown in FIG. 6B, it is also envisioned that the preferred embodiment may further comprise a patch 24 or other device for covering up the inside portion of the attachment means 3 to further make the present invention comfortable and keep the fasteners from chafing the wearer through the sock material, especially where the fastener itself extends through the sock material. It is envisioned that the patch may also comprise a label containing the sock size or the shoe size and may contain other material such as care instructions.

Figure 9A:
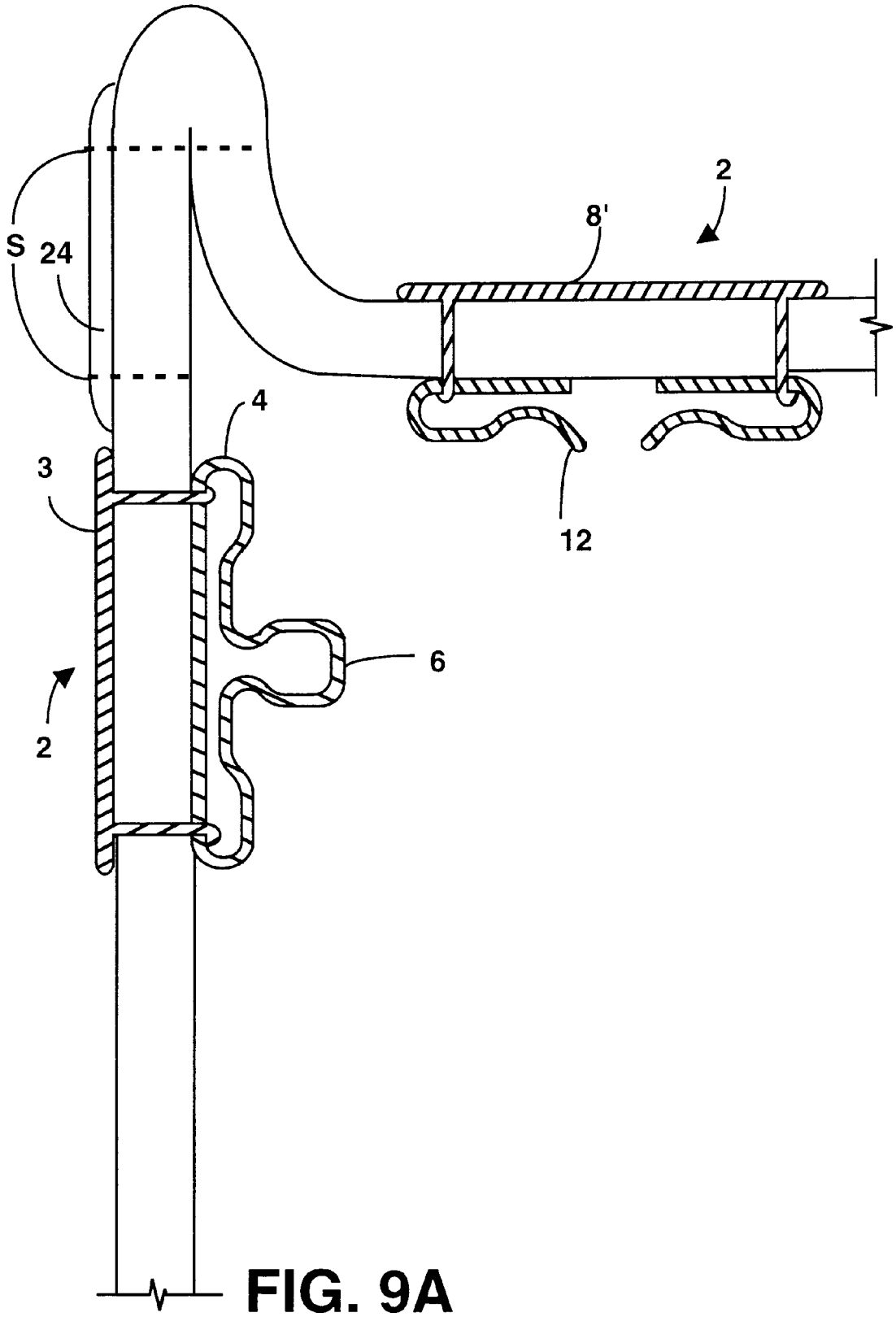
FIG. 9A is a cross-sectional view of another embodiment of one article of the present invention.
Figure 9B:
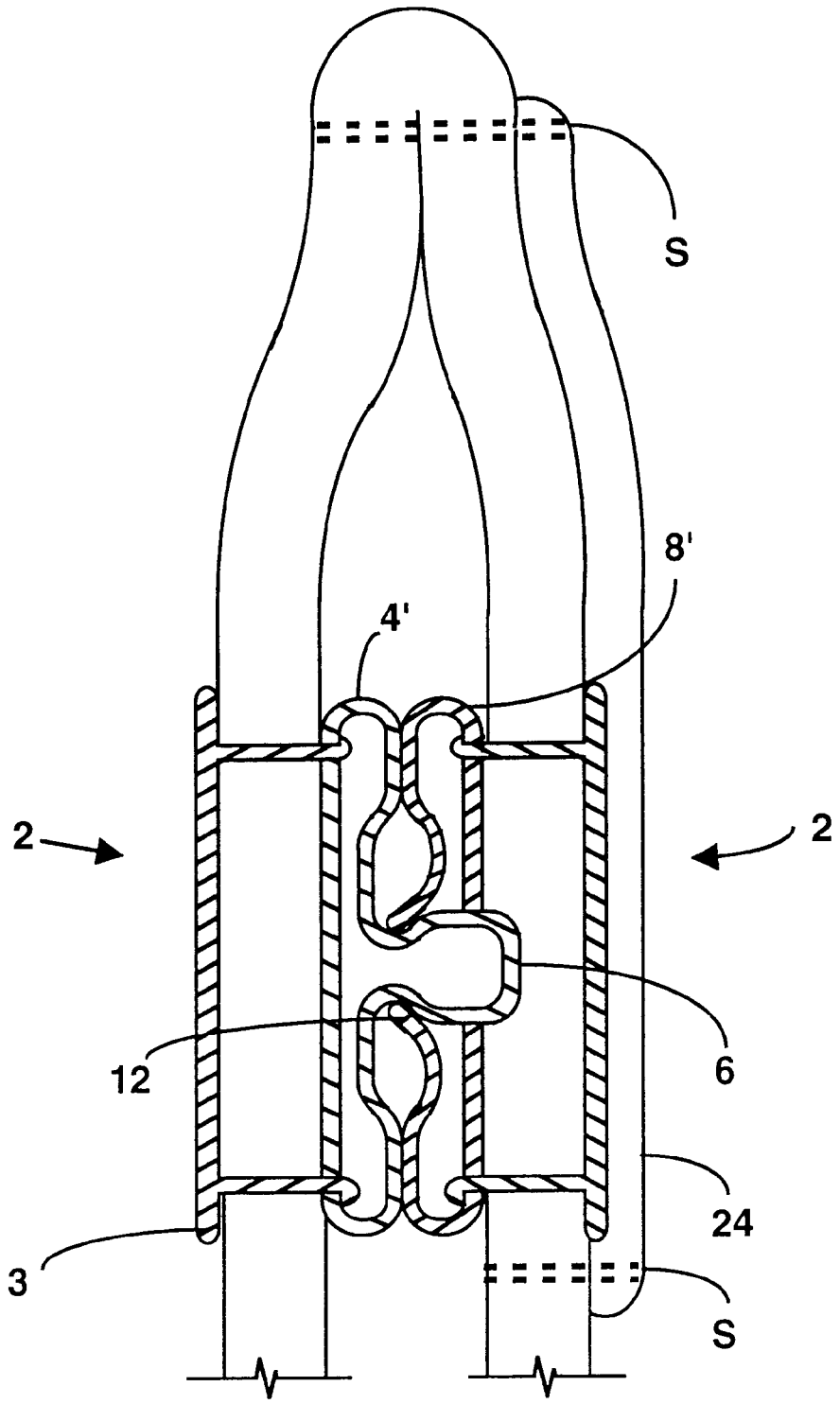
FIG. 9B is a cross-sectional view of another embodiment of one article of the present invention.

Other embodiments of such a patch 24 are shown in FIGS. 9A and 9B. These Figures show that the stitching "S" for attaching the label to the sock may further extend through the first over portion of the sock and affix the first portion to the second portion. This would be created by folding the sock at a line generally exactly between the male fastener and the female fastener and then affixing this fold together so as to create a crease or permanent fold in the sock that would make the sock inclined to remain fixedly folded. Such fold could be created other ways, including adhering the folded over portions of the sock together. Alternatively, such fixation may exist absent a patch 24. In all such embodiments, the user will be able to pull back the top folded over portion and attach it to a likewise unfolded sock. FIG. 9A shows the default status fold, and FIG. 9B shows the folded sock snapped together.

Thus, in use, assuming that the user starts with a pair of socks as disclosed above already engagably attached to one another, first the user would unsnap the two socks from one another and place one sock on each foot. Then, the top of the sock would be turned inside out so that the first fastening means of the first sock would be releasably engaged with the second fastening means of the same sock, such engagement requiring reversing and folding down of the sock to generally the line marked as 'A' in the Figures, thereby covering the attachment of the fastener to one another. The same would be repeated on the second sock, noting the difference that in the second sock, preferably, the second fastener means would be located above the first fastener means and, as such, the sock would be folded so that the second fastener means may engage the first fastener means. Then, when the user is through wearing the socks, the user could take them off, taking care to snap them together, first fastener means of the first sock attached to the second fastener means of the second sock and the first attachment means of the second sock attached to the second attaching means of the first sock, thereby fixedly holding the pair of socks together to be laundered. After being laundered, the paired socks will be still attached to one another and the user will merely need to store the attached socks together, without having to dig through a pile of different socks looking for mates to the individual socks.

While there is shown and described the present preferred embodiment of the invention, it is to be distinctly understood that this invention is not limited thereto but may be variously embodied to practice within the scope of the following claims.

From the foregoing description, it will be apparent that various changes may be made without departing from the spirit and scope of the invention as defined by the following claims.

I claim:

1. A fastening means for a pair of socks comprising a first sock and a second sock, each sock having a snap-type fastening means for securing said pair of socks together to prevent the separation thereof during storage, washing, and drying, wherein said fastening means further comprises:

two first fasteners each having a part providing a projection;

means for attaching one of said first fasteners to each of said pair of socks;

two second fasteners each having a part providing a hole;

means for attaching one of said second fasteners to each of said pair of socks;

said first and second fasteners being constructed and arranged to be releasably engageable with one another with said projections fitting into said holes with snap-like fits;

wherein on each of said pair of socks, said first fastener and said second fastener are adjacent to one another;

wherein said first sock and said second sock each have a first side opposite a second side, an inside surface and an outside surface, wherein the first side of the first sock faces the second side of the second sock when said socks are mated, wherein said fasteners located on said first sock are located on the first side of the first sock, and said fasteners located on said second sock are located on the second side of said second sock;

wherein said projection and hole providing parts of said first and second fasteners are arranged to face outwardly from the outside surface of the leg of each sock;

wherein each of said socks further comprise patches located on the inner side of each sock opposing said fastener located on the outer side of the leg of each sock for elimination of contact between the fasteners and the wearer of said socks;

wherein said first sock is fixedly folded so that the first fastener of said first sock may releasably engage with the second fastener of said first sock; and wherein said second sock is fixedly folded so that the first fastener of said second sock may releasably engage with the second fastener of said second sock.

2. A fastening means for a pair of socks comprising a first sock and a second sock, each sock having a snap-type fastening means for securing said pair of socks together to prevent the separation thereof during storage, washing, drying and, wherein said fastening means further comprises:

two first fasteners each having a part providing a projection, means for attaching one of said first fasteners to each of said pair of socks, two second fasteners each having a part providing a hole, means for attaching one of said second fasteners to each of said pair of socks; and, said first and second fasteners being constructed and arranged to be releasably engageable with one another with said projection fitting into said hole with a snap-like fit.

3. The fastening means for a pair of socks as in claim 2, wherein on each of said pair of socks, said first fastener and said second fastener are adjacent to one another.

4. The fastening means for a pair of socks as in claim 2, wherein each sock has a first side opposite a second side, an inside surface and an outside surface, wherein the first side of the first sock faces the second side of the second sock when said socks are mated, wherein said fasteners located on said first sock are located on the first side of the first sock, and said fasteners located on said second sock are located on the second side of said second sock.

5. The fastening means for a pair of socks as in claim 2, wherein said projection and hole providing parts of said first and second fasteners are arranged to face outwardly from the outside surface of the leg of each sock.

6. The fastening means for a pair of socks as in claim 2, wherein the leg portions of each of said socks are able to be turned inside out so that the first fastener of said first sock may releasably engage with the second fastener of said first sock and so that the first fastener of said second sock may releasably engage with the second fastener of said second sock.

* * * * *